US012458122B2

(12) United States Patent
Harms

(10) Patent No.: US 12,458,122 B2
(45) Date of Patent: Nov. 4, 2025

(54) DOUBLE ZIPPER ASSEMBLY

(71) Applicant: X-CEN-TEK GmbH & Co. KG, Wardenburg (DE)

(72) Inventor: Andreas Harms, Bad Zwischenahn (DE)

(73) Assignee: X-CEN-TEK GmbH & Co. KG, Wardenburg (DE)

( * ) Notice: Subject to any disclaimer, the term of this patent is extended or adjusted under 35 U.S.C. 154(b) by 0 days.

(21) Appl. No.: 18/302,361

(22) Filed: Apr. 18, 2023

(65) Prior Publication Data

US 2023/0329408 A1 Oct. 19, 2023

(30) Foreign Application Priority Data

Apr. 19, 2022 (DE) ..... 202022102075.2

(51) Int. Cl.
*A45C 13/10* (2006.01)
*A44B 19/34* (2006.01)
*A45C 5/03* (2006.01)

(52) U.S. Cl.
CPC ..... *A45C 13/103* (2013.01); *A44B 19/34* (2013.01); *A45C 5/03* (2013.01)

(58) Field of Classification Search
CPC ..... A45C 13/103; A45C 5/03; A44B 19/34
USPC ..... 190/119
See application file for complete search history.

(56) References Cited

U.S. PATENT DOCUMENTS 4,773,515 A * 9/1988 Kotkins, Jr. ..... A45C 7/0068 190/111

FOREIGN PATENT DOCUMENTS

| | | | |
|---|---|---|---|
| CN | 201533632 U | * | 7/2010 |
| DE | 102014110934 A1 | | 2/2016 |
| DE | 202021101323 U1 | | 3/2021 |

* cited by examiner

*Primary Examiner* — Nathan J Jenness
*Assistant Examiner* — Jessica Kavini Tamil
(74) *Attorney, Agent, or Firm* — Renner, Otto, Boisselle & Sklar, LLP.

(57) ABSTRACT

A double zipper assembly includes a first zipper and a second zipper, each having a pair of side portions with teeth and at least one slider. The pairs of side portions of the first zipper and of the second zipper are each sectionally interconnected by means of a web. A side portion of the pair of side portions of the first zipper is connected with a side portion of the pair of side portions of the second zipper along its entire length. The webs of both zippers are disposed offset to one another with respect to the longitudinal direction of their side portions.

2 Claims, 6 Drawing Sheets

DOUBLE ZIPPER ASSEMBLY

This application claims priority to German Application No. 202022102075.2 filed Apr. 19, 2022, which is hereby incorporated herewith by reference in its entirety.

The invention relates to a double zipper assembly in accordance with the preamble of claim 1. In particular, the invention relates to a double zipper assembly for variably connecting two components.

A zipper, also referred to as a zip fastener or zip, for short, is an easy-to-open fastener for bags on the basis of a form fit. It consists of two side portions having teeth, also referred to as elements, and a slider, also referred to as a zipper car, with which the teeth can be hooked together and then released again.

In the present document, all containers serving as transport means for transporting objects are referred to as bags. Examples of bags are cargo bags, backpacks and suitcases. Bags often comprise handles, handholds or other devices for holding them by hand or otherwise carrying them on the body and transporting them.

Bags comprising a circumferential zipper are well known. There, two components are joined together by means of a circumferential zipper. There are variants where a complete opening of the zipper results in separation of the two components. This is known, for example, in backpacks or satchels, which are therefore variable in weight and storage volume. Also known are variants where both components are kept interconnected alongside a web section via a web that is, for example, limp or resiliently flexible and designed without the zipper.

In addition, from DE 20 2021 101 323 U1 a bag consisting of two hingedly interconnected components that may be closed against one another by means of a first zipper of a double zipper assembly, such that they enclose an interior of the bag together. A second zipper of the double zipper assembly is disposed in the same plane as the first one. By opening the first zipper, the bag may be unfolded to expose a first portion of the bag interior surrounded by one of the components. The contents of a portion of the bag interior surrounded by the other component remains closed at first by means of a partition that may be unfolded by opening the second zipper when the bag is unfolded. This allows, for example, to transport a delicate piece of clothing within a portion of the interior of the bag, for instance within the component that is kept closed off by means of the partition, such that it is protected from the objects stowed within the other component, but still easily accessible by means of the second zipper.

DE 10 2014 110 934 A1 discloses a bag having two side pockets disposed adjacent to each other on the same side that can be closed by means of two peripherally extending zippers. In order for the lower side pocket to be able to fold onto the upper side pocket about its web section without obstruction by the upper side pocket, its zipper extends in a plane that is spaced apart farther from the side of the bag than the zipper of the upper side pocket.

A disadvantage of the known zipper assemblies comprising a web is that complete access to the contents within the bag that is enclosed by the two components which can be closed against each other by means of the zipper assembly and are interconnected by means of the web is subject to a structure determined by the arrangement of the web and inevitably requires a space for handling, the shape and dimensions of which corresponds to at least the shape and the outer dimensions of the two components connected by means of the web when in the unfolded state.

Particularly in cramped spaces, this may render the handling of the bag and in particular a quick, unobstructed access to the objects transported within the bag considerably more difficult in emergencies.

It is an object of the invention to provide a zipper assembly with variable possibilities for handling.

The object is achieved by the features of the independent claim. Advantageous embodiments are given in the claims, the drawings, and the following description, including the description of the drawings.

A first subject matter of the invention relates to a double zipper assembly. The double zipper assembly comprises a first zipper and a second zipper. Each of the two zippers comprises a pair of side portions each having teeth and at least one slider.

The pairs of side portions of the first and second zippers are each sectionally connected alongside a web section with a web that is limp or resiliently flexible, for example. Even when the first zipper is completely opened, the two side portions of the pair of side portions of the first zipper remain connected to one another by means of a web, in the following also referred to as a first web, of a first web section. The two side portions of the second zipper remain connected to one another as well when the second zipper is completely opened, by means of a web, in the following also referred to as a second web, of a second web section.

Thus, each of the side portions extends over its toothed portion plus the toothless web section, which connects each side portion with its opposite side portion to form a pair of side portions.

In the double zipper assembly, a side portion of the pair of side portions of the first zipper is connected, along its entire length, with a side portion of the pair of side portions of the second zipper.

The double zipper assembly is characterized in that the webs of the first and second web sections of both zippers are disposed offset to one another with respect to the longitudinal direction of their side portions.

If the double zipper assembly is used, for instance, in connection with a bag with two components that can be unfolded and closed relative to one another by means of the double zipper assembly, it allows, after opening the first zipper, to unfold the two components along the edges of the two components that face each other along the sides provided with the first web section. When the second zipper is opened, it allows to unfold the two components along those edges of the two components which face one another and which extend along the sides provided with the second web section. Preferably, these are two sides adjoining at a corner. When the closed bag has a rectangular cross section of the bag interior between the two components, it can be opened, on one hand, about its short narrow side, which requires a somewhat shallower, but perpendicular to its depth broader space for handling when completely unfolded, on the other hand, it can be opened about its longer longitudinal side, which requires a deeper, but narrower space for handling. This may, for example, be particularly advantageous in an ambulance, where only spaces of shallow depth for placing objects are available next to a stretcher when viewed in the direction of travel, whereas deeper handling spaces that are narrower in width are available in front or behind the stretcher.

A second subject matter of the invention relates to a bag comprising two components that may be unfolded and closed against each other by means of the double zipper assembly described above.

A cross section of the bag between the two components has two opposing longitudinal sides that are interconnected by means of two narrow sides which are also opposite one another.

The bag is preferably characterized in that the two components can be unfolded and closed, on one hand about the web of a web section of one of the zippers of the double zipper assembly, said web section being disposed at a longitudinal side of the cross section, and on the other hand about the web of a web section of the other one of the zippers of the double zipper assembly, said web section being disposed at a narrow side of the cross section.

It is important to note that the invention may be implemented with a bag comprising two interconnected components that may be unfolded and closed against each other about the webs by means of a double zipper assembly described above, the two components, in the closed state, enclosing an interior of the bag for holding objects.

Alternatively or additionally, the double zipper assembly may include, individually or in combination, one or more of the features that are described at the beginning in connection with the prior art, mentioned in one or more of the documents of the prior art, described in the following description of the exemplary embodiments illustrated in the drawings, and/or included in the claims.

Additional advantages compared to the prior art that go beyond the complete achievement of the object and/or the advantages mentioned above for the individual features are also described below.

The invention will be discussed in more detail with the help of the example embodiments illustrated in the drawings. The proportions of the individual elements to one another in the figures do not always correspond to the real proportions, since some shapes are shown in simplified form and other shapes are shown enlarged in relation to other elements for better illustration. Identical reference symbols are used for elements of the invention that are the same or have the same effect. Furthermore, for the sake of clarity, only reference symbols are shown in the individual figures that are necessary for the description of the respective figure. The illustrated embodiments only represent examples of how the invention can be configured and do not represent any final limitation. The figures illustrate schematically:

Figure 4:
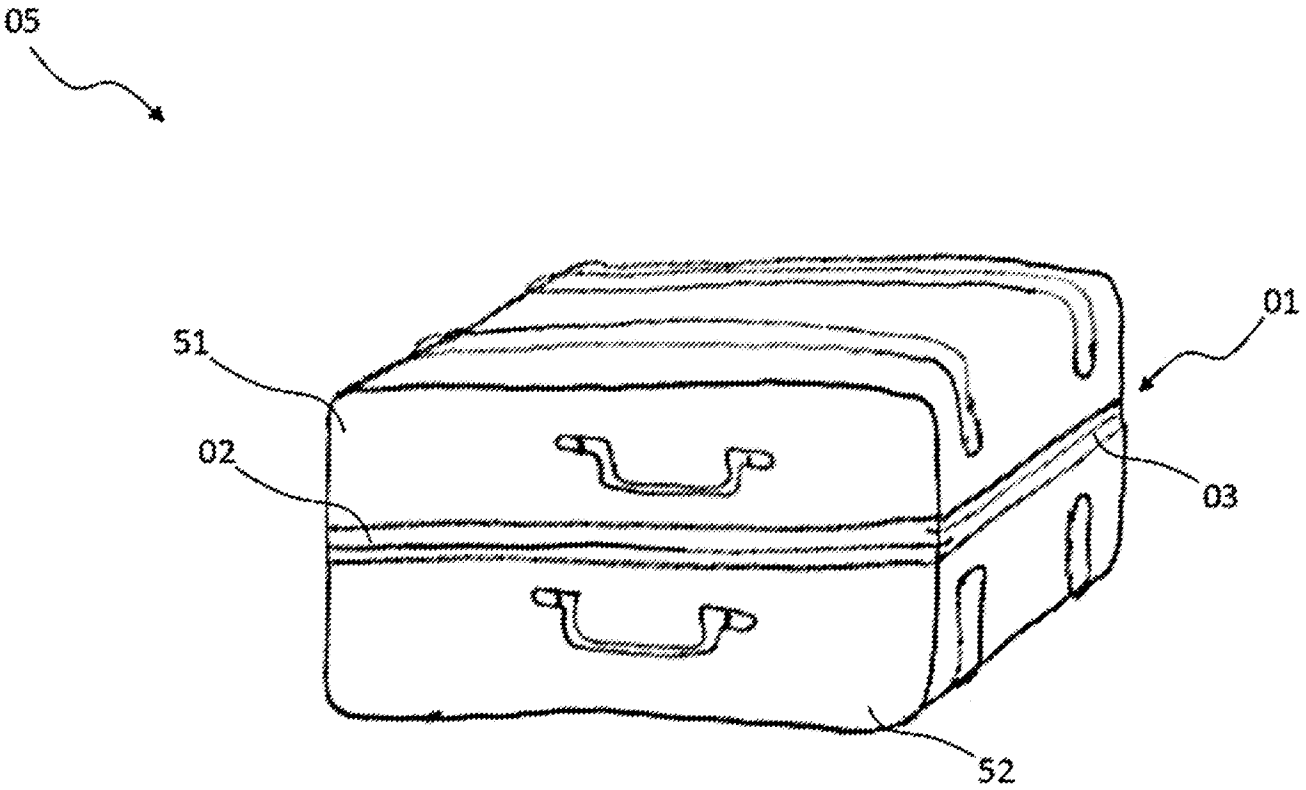

FIG. 4 is a perspective view of a closed bag 05 comprising two components 51, 52 in a perspective view that are unfoldably interconnected by means of a double zipper assembly 01 and may be closed against one another by said assembly.

Figure 1:
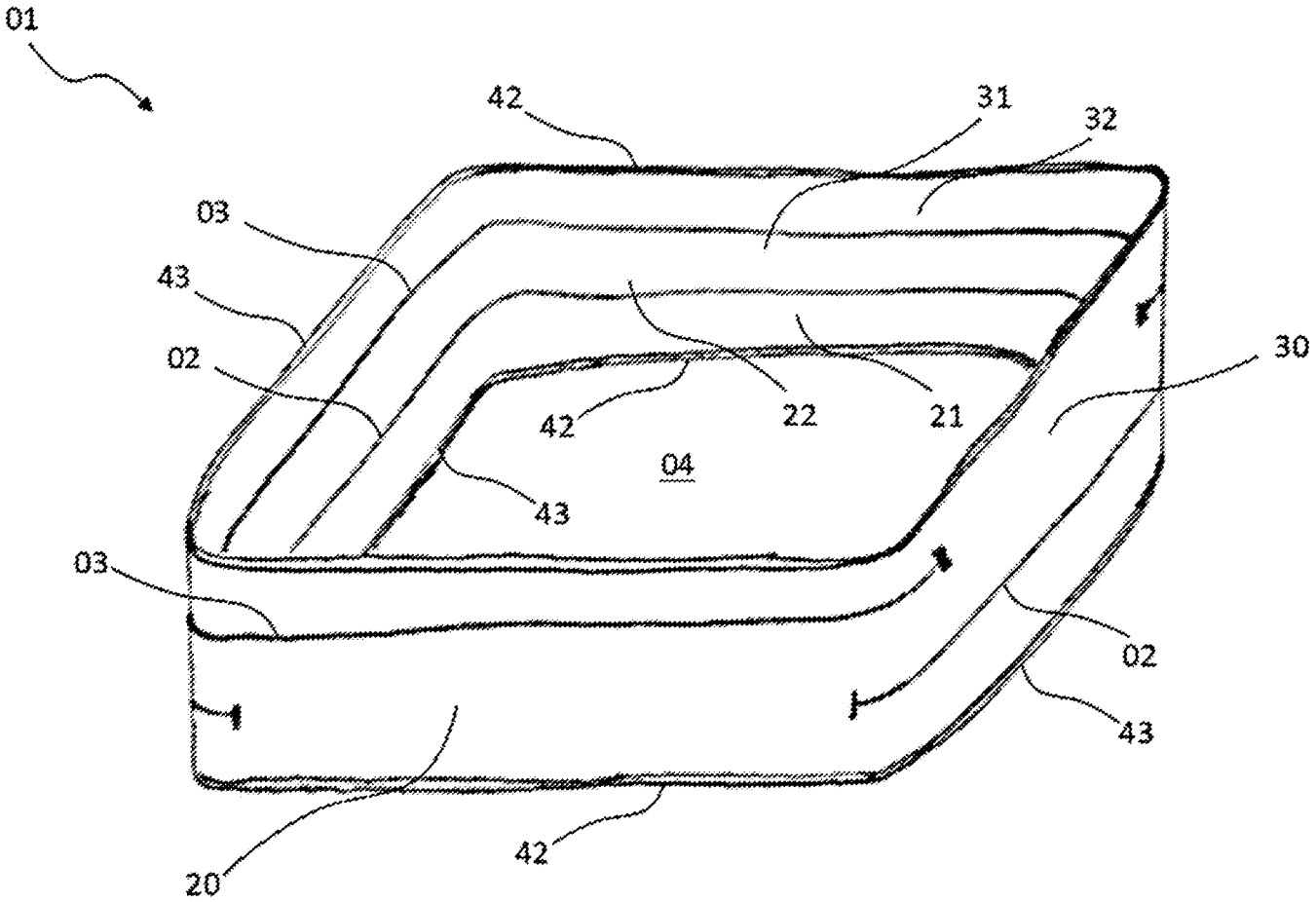
FIG. 1 depicts a perspective view of a double zipper assembly comprising two zippers 02, 03 in a closed state.
Figure 5:
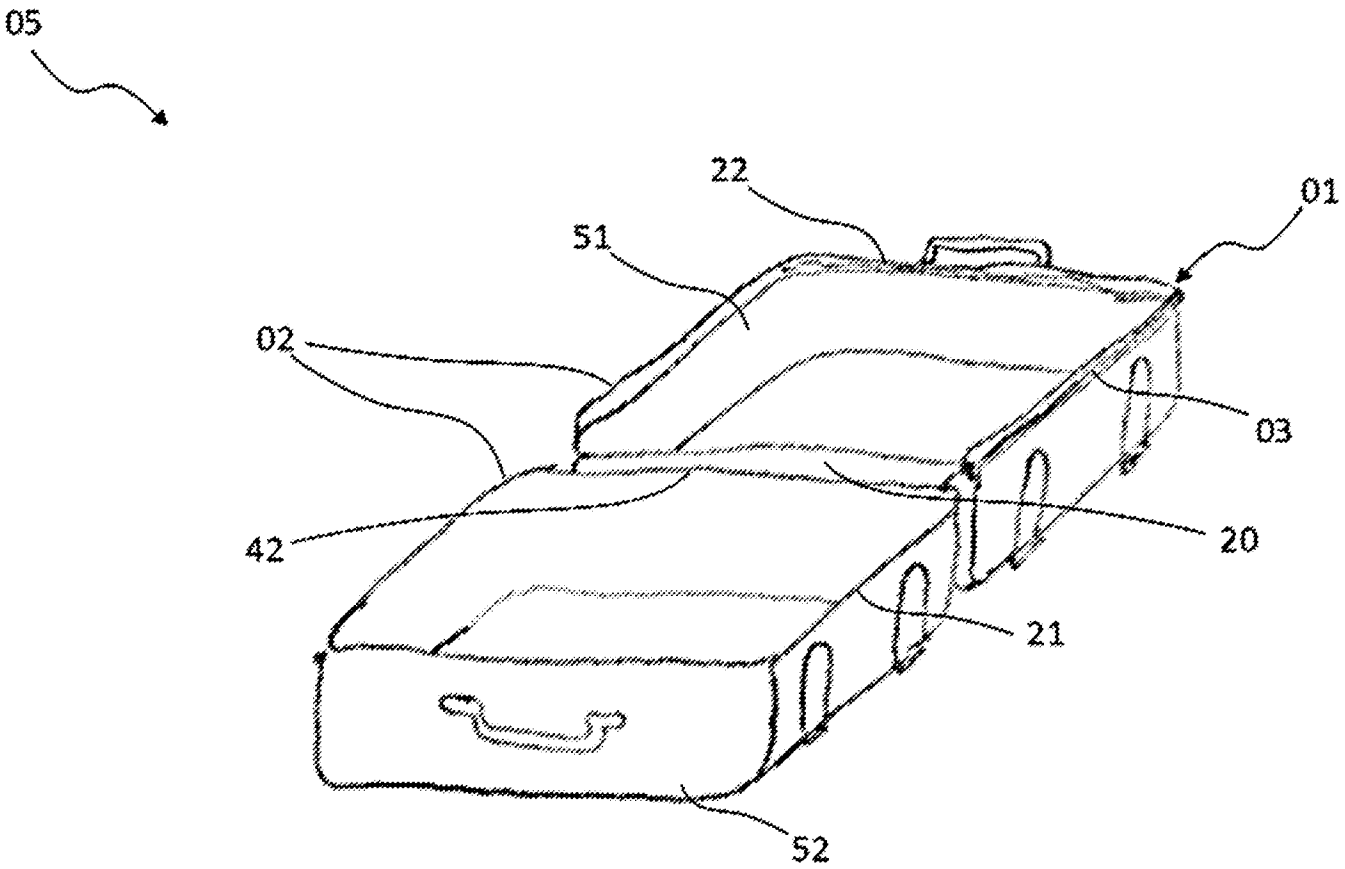

FIG. 5 is a perspective view of the bag of FIG. 1 in an unfolded state about the first web 20 of the opened first zipper 02 of the double zipper assembly 01.

Figure 6:
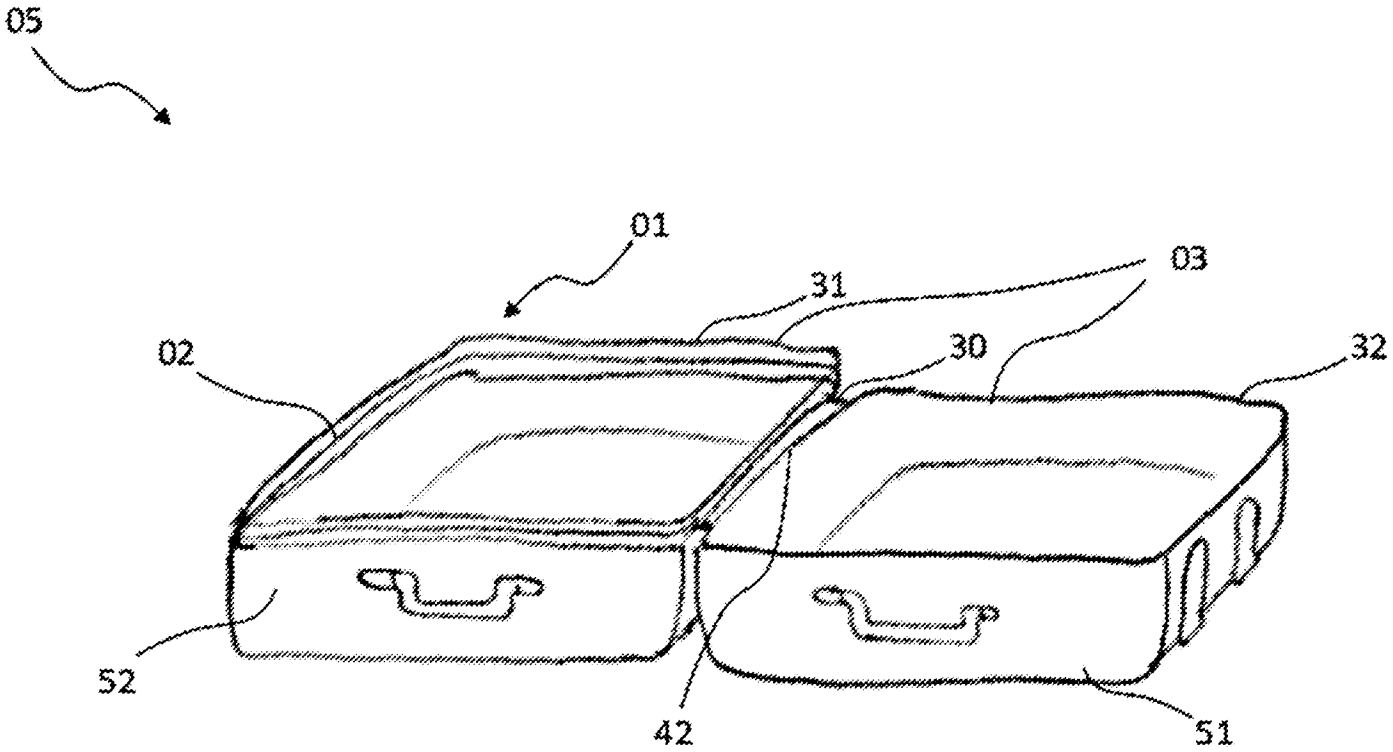

FIG. 6 is a perspective view of the bag of FIG. 1 in an unfolded state about the second web 30 of the opened second zipper 03 of the double zipper assembly 01.

A double zipper assembly 01 that is shown fully or in part in FIG. 1, FIG. 2, FIG. 3, FIG. 4, FIG. 5, FIG. 6, comprises:

- a first zipper 02 disposed in a first plane and
- a second zipper 03 disposed in a second plane which is spaced apart from the first plane, each having a pair of toothed side portions with at least one slider.

Note that the term plane, in a deviation from its mathematical meaning, also refers to a planar extension of a limp element.

The pairs of side portions of the first zipper 02 and the pairs of side portions of the second zipper are each sectionally connected via a web section with a web 20, 30 that is limp or resiliently flexible, for example.

Thus, each of the side portions 21, 22, 31, 32 extends over its toothed portion plus the toothless web section with the corresponding web 20, 30, which connects each side portion 21, 31 with the remaining opposite side portion 22, 32 of each side portion pair to form a pair of side portions.

Even when the first zipper 02 is completely opened, the two side portions 21, 22 of the pair of side portions of the first zipper 02 remain connected to one another by means of the web 20, in the following also referred to as a first web, of a first web section. The two side portions 31, 32 of the second zipper 03 remain connected to one another as well when the second zipper 03 is completely opened, by means of the web 30, in the following also referred to as a second web, of a second web section.

In the double zipper assembly 01, a side portion 22 of the pair of side portions of the first zipper 02 is connected, across its entire length, with a side portion 31 of the pair of side portions of the second zipper 03.

The webs 20, 30 of the first and second web sections of the two zippers 02, 03 are disposed offset to one another with respect to the longitudinal direction of their side portions 21, 22, 31, 32.

Hereinafter, the double zipper assembly 01 may be viewed as comprising a top portion, a middle portion, and a bottom portion which are interconnected by means of the two zippers 02, 03 at their web sections including the webs 20, 30.

A middle portion of the double zipper assembly 01 is therefore formed by connecting a side portion 22 of the first zipper 02, across its full length including the web section next to the first web 20, with a side portion 31 including its web section of the second zipper 03 next to the second web 30. The remaining side portion 21 of the first zipper 02, in combination with the web section, forms a bottom portion of the double zipper assembly 01 (FIG. 1). The remaining side portion 32 of the second zipper 03, in combination with the web section, forms a top portion of the double zipper assembly 01 (FIG. 1). The first web 20 of the first zipper 02 and the second web 30 of the second zipper 03 are disposed offset to one another with respect to the longitudinal direction of the two zippers 02, 03.

It must be emphasized that the terms top portion and bottom portion are merely for distinction and do not represent any specification or restriction with regard to the spatial arrangement.

Preferably, the webs 20, 30 of the two web sections do not overlap one another at least in sections.

When the web section or the web 20, 30 of the one zipper 02, 03 is disposed along a section of the pair of side portions of the double zipper assembly 01, then preferably a toothed section of the other zipper 03, 02 is disposed within said web section.

Most preferably, the webs 20, 30 of the two zippers 02, 03 are disposed such that they do not overlap one another at all.

In the closed state of its two zippers 02, 03, the double zipper assembly 01 is disposed circumferentially around a common opening 04 (FIG. 1).

Advantageously, the double zipper assembly 01 surrounds the common opening 04 in the closed state of its two zippers 02, 03. In other words, when its two zippers 02, 03 are closed, the double zipper assembly 01 is configured circumferentially around the common opening 04. Accordingly, both the first zipper 02 comprising the first web 20 and the second zipper 03 comprising the second web 30 are configured and disposed circumferentially around the common opening 04 when the double zipper assembly 01 is closed.

In the closed state of the double zipper assembly 01, the common opening 04 passes through all of the aforementioned bottom portion and the middle portion and the top portion of the assembly.

The common opening 04 may span an area with mutually opposite longitudinal 42 and narrow sides 43. This area may also be referred to as a connecting surface. This area may be occupied by each of the two components 51, 52 of a closed bag 05 that face each other, where the components may be connected to one another in variably unfoldable fashion by means of the double zipper assembly 01, or each of the two components may span this area with their edges that face the double zipper assembly 01.

The connecting surface spanning the common opening corresponds to each of the two cross sections through the double zipper assembly 01 at a height of the one or the other closed zipper 02, 03.

Advantageously, each of the middle portion as well as the top and bottom portions span the connecting surface individually.

The connecting surface may have an approximately rectangular geometry with opposing longitudinal sides 42 and narrow sides 43.

The two webs 20, 30 are disposed at different longitudinal sides 42 and/or narrow sides 43 of the connecting surface.

For example, the two webs 20, 30 may be disposed at adjoining longitudinal 42 and narrow sides 43 of the connecting surface spanned by the cross section between the two zippers 02, 03 of the double zipper assembly 01, as illustrated in FIG. 1, FIG. 2, FIG. 3, FIG. 4, FIG. 5, FIG. 6.

Figure 2:
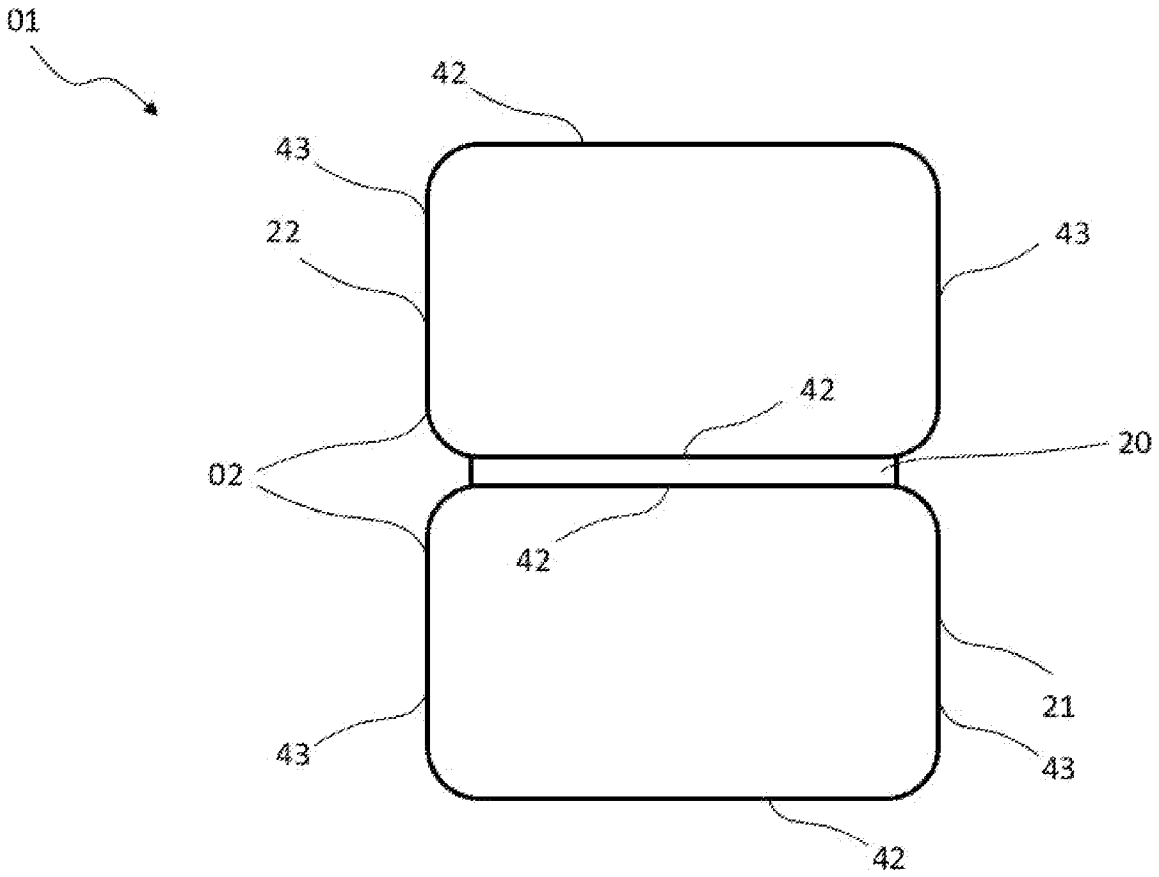
FIG. 2 shows a plan view of the double zipper assembly of FIG. 1 with the first zipper 02 open and in an unfolded state about the first web 20.
Figure 3:
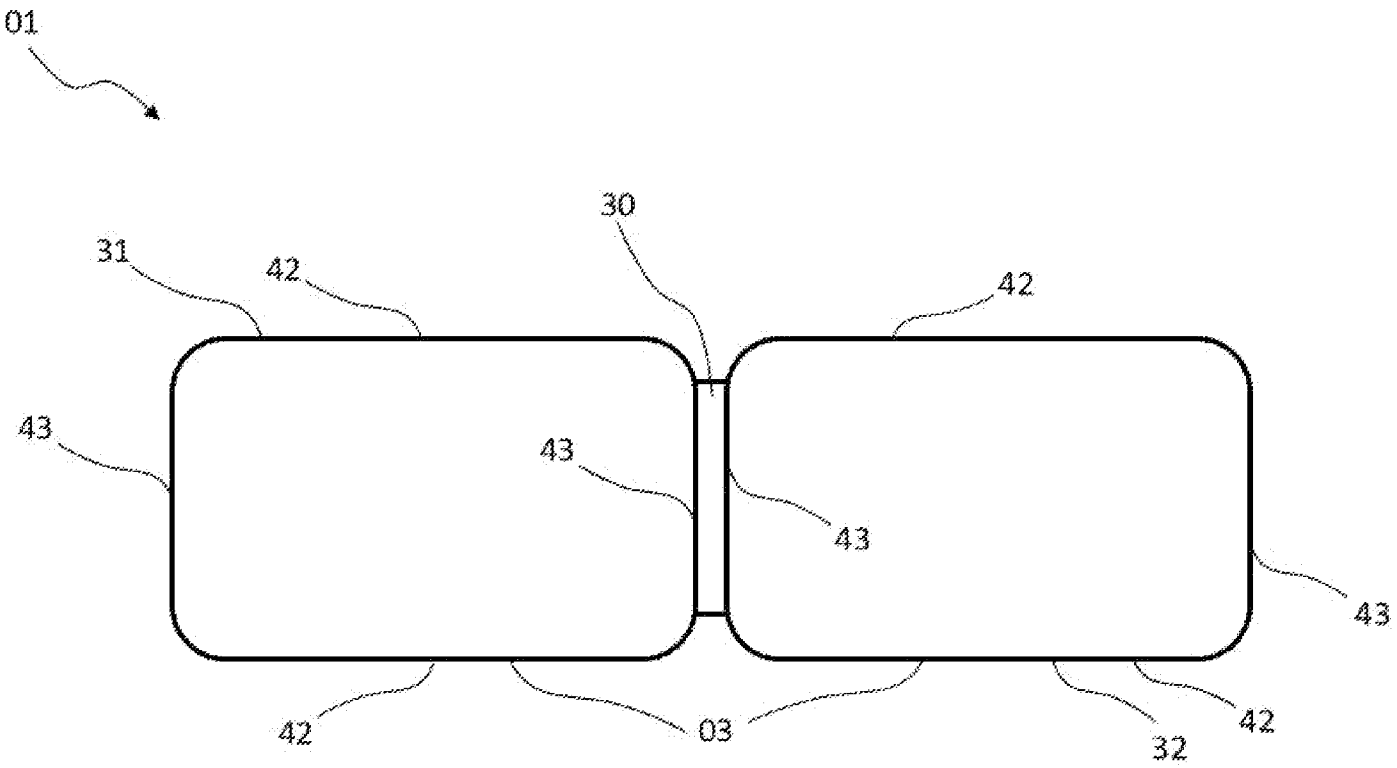
FIG. 3 shows a plan view of the double zipper assembly of FIG. 1 with the second zipper 03 open and in an unfolded state about the second web 30.

This allows the unfolding according to whether a narrower but deeper, or a broader but shallower space for handling is available, depending on which of the two zippers 02, 03 is opened. If the space for handling is rather narrow but fairly deep, the zipper 02 is opened on the longitudinal side 42 in order to unfold the bag 05 (FIG. 2, FIG. 5). If the space for handling is less deep but broader, the zipper 03 is opened on the narrow side 43 in order to unfold the bag 05 (FIG. 3, FIG. 6).

Alternatively, the two webs 20, 30 may be disposed at opposing longitudinal 42 or narrow sides 43 of the connecting surface spanned by the cross section between the two zippers 02, 03 of the double zipper assembly 01.

When a bag 05 comprising the double zipper assembly 01 is set down in order to connect its two components 51, 52 that may be interconnected for unfolding and closing against each other, the bag can be unfolded selectively in one direction or the other direction, depending on which of the two zippers 02, 03 is opened, when the webs 20, 30 are disposed at opposing longitudinal sides 42 or at opposing narrow sides 43. This considerably increases ease of handling, because the bag 05, once set down, does not have to be picked up and turned or shifted, for example, when the necessary clearance is only available for unfolding to the left or the right, or only to the front or back, for instance.

A bag 05 illustrated in FIG. 4, FIG. 5, FIG. 6 comprises two components 51, 52 that may be unfolded and closed against each other by means of the double zipper assembly 01 described above.

A cross section of the closed bag 05 between the two components 51, 52 has two opposite longitudinal sides 42 that are interconnected by means of two narrow sides 43 which are also opposite one another. Each of the two components 51, 52 spans an area of equal dimensions with its open side facing the double zipper assembly 01.

On one hand, the two components 51, 52 may be unfolded and folded about the web 20 of a web section of one of the two zippers 02 of the double zipper assembly 01, the web section being disposed at a longitudinal side 42 of the cross section, or, on the other hand, they may be unfolded or folded about the web 30 of a web section of the other one of the two zippers 03 of the double zipper assembly 01, the web section being disposed at a narrow side 43, depending on which of the two zippers 02, 03 is opened and which one is closed.

If the double zipper assembly 01 is used, for instance, in connection with a bag 05 with two components 51, 52 that can be unfolded and closed relative to one another by means of the double zipper assembly 01, it allows, after opening the first zipper 02, to unfold the two components 51, 52 along the common edge of the two components 51, 52 that extends along the side provided with the first web section, for example a longitudinal side 42. When the second zipper 03 is opened, it allows to unfold the two components 51, 52 along the common edge of the two components 51, 52 which extends along the sides provided with the second web section, for example a narrow side 43. Preferably, these are two sides adjoining at a corner. When the closed bag 05 has a rectangular cross section of the bag interior between the two components 51, 52, it can be opened, on one hand, about its short narrow side 43, which requires a somewhat shallower, but perpendicular to its depth broader space for handling when completely unfolded, on the other hand, it can be opened about its longer longitudinal side 42, which requires a deeper, but narrower space for handling.

Both the double zipper assembly 01 as well as alternatively or additionally the bag 05 may include, individually or in combination, one or more of the features that are described at the beginning in connection with the prior art, mentioned in one or more of the documents of the prior art, described in the above description of the exemplary embodiments illustrated in the drawings.

The invention is not limited by the description of exemplary embodiments. Rather, the invention encompasses any novel feature and also any combination of features, which includes, in particular, any combination of features in the claims, even if this feature or this combination itself is not explicitly specified in the claims or exemplary embodiments.

The invention has industrial applicability, in particular, for manufacturing zippers and bags comprising such zippers, in particular of emergency bags and first aid bags, for example for emergency physicians and paramedics for rendering first aid in the field or in an ambulance, where a plurality of objects for medical first aid must be made available within a very short time in a clearly arranged manner in a cramped environment.

The invention has been described by reference to preferred embodiments. However, it will be apparent to a person skilled in the art that modifications or variations can be made in the invention without departing from the scope of the following claims.

LIST OF REFERENCE NUMERALS

01: double zipper assembly
02: zipper
03: zipper
04: common opening
05: bag
20: web
21: side portion
22: side portion
30: web
31: side portion
32: side portion
42: longitudinal side
43: narrow side
51: component
52: component

CITATIONS INCLUDED IN THE SPECIFICATION

Patent Literature Cited

DE 202021101323 U1 [0005]
DE 102014110934 A1 [0006]

The invention claimed is:

1. A bag having two components that are configured to be unfolded and closed against one another by means of a double zipper assembly, wherein the double zipper assembly comprises:

a first zipper and a second zipper, each having a pair of side portions with teeth and at least one slider, wherein the first zipper and the second zipper are configured for operation between an open state and a closed state, wherein when the first zipper is in the closed state and the second zipper is in the closed state the double zipper assembly is disposed circumferentially around a common opening, the pair of side portions of the first zipper are sectionally interconnected by means of a first web and the pair of side portions of the second zipper are sectionally interconnected by a second web, a side portion of the pair of side portions of the first zipper is connected with a side portion of the pair of side portions of the second zipper along an entire length of the side portion of the pair of side portions of the first zipper, and the first web of the first zipper and the second web of the second zipper are disposed offset to one another with respect to the longitudinal direction of their side portions such that the first web and the second web do not overlap one another in a direction perpendicular to a plane in which the common opening lies wherein:

a cross section of the bag between the two components has two opposite longitudinal sides that are interconnected by means of two narrow sides which are also opposite one another, and the two components, on one hand, may be unfolded and folded about the first web of the double zipper assembly, the first web being disposed at a longitudinal side, and, on the other hand, may be unfolded or folded about the second web of the double zipper assembly, the second web being disposed at a narrow side, depending on which of the two zippers is opened and which one is closed, wherein the first web is disposed only on a longitudinal side of the cross section of the bag, and the second web is disposed only on a narrow side of the cross section of the bag.

2. A double zipper assembly, comprising:

a first zipper and a second zipper, each having a pair of side portions with teeth and at least one slider, wherein the first zipper and the second zipper are configured for operation between an open state and a closed state, wherein when the first zipper is in the closed state and the second zipper is in the closed state, the double zipper assembly is disposed circumferentially around a common opening, the common opening spans an area with mutually opposite longitudinal and narrow sides adjacent to each other, the pair of side portions of the first zipper are sectionally interconnected by means of a first web and the pair of side portions of the second zipper are sectionally interconnected by a second web, a side portion of the pair of side portions of the first zipper is connected with a side portion of the pair of side portions of the second zipper along an entire length of the side portion of the pair of side portions of the first zipper, and the first web is disposed only on a longitudinal side of the common opening and the second web is disposed only on a narrow side of the common opening such that the first web and the second web do not overlap one another in a direction perpendicular to a plane in which the common opening lies.

* * * * *